United States Patent [19]

Doori

[11] 4,337,877

[45] Jul. 6, 1982

[54] APPARATUS FOR SUPPLYING SLIDE FASTENER SLIDERS

[75] Inventor: Hisashi Doori, Kurobe, Japan

[73] Assignee: Yoshida Kogyo K.K., Japan

[21] Appl. No.: 184,029

[22] Filed: Sep. 4, 1980

[30] Foreign Application Priority Data

Sep. 7, 1979 [JP] Japan ..... 54-124216[U]

[51] Int. Cl.[3] ..... B65H 9/00; B23Q 7/10

[52] U.S. Cl. ..... 221/171; 221/238; 221/312 A; 29/409; 29/768; 29/809

[58] Field of Search ..... 221/171, 236, 224, 238, 221/239, 270, 312 R, 312 A, 312 B; 29/409, 768, 809

[56] References Cited

U.S. PATENT DOCUMENTS 2,949,666 8/1960 Rogers et al. ..... 29/768
3,956,812 5/1976 Kawakami et al. ..... 29/809
4,049,155 9/1977 Kawakami et al. ..... 221/270
4,135,285 1/1979 Weiner ..... 29/409

*Primary Examiner*—H. Grant Skaggs
*Attorney, Agent, or Firm*—Robert E. Burns; Emmanuel J. Lobato; Bruce L. Adams

[57] ABSTRACT

An apparatus for supplying slide fastener sliders comprises a track for carrying thereon the sliders stacked sideways with their respective pull tabs arranged in the recumbent position for gravity delivery of the sliders to a groove in a base. A slider retainer is engageable with the recumbent pull tab of the leading slider for retaining the same with the slider body position so as to release the same from engagement with the slider retainer, and substantially at the same time to allow the leading slider to fall in the groove. A feeding device feeds the slider in and along the groove to a predetermined position. The apparatus further comprises an arrangement for correcting the posture of the slider to have the pull tab raised substantially perpendicularly to the slider body wings.

10 Claims, 2 Drawing Figures

APPARATUS FOR SUPPLYING SLIDE FASTENER SLIDERS

BACKGROUND OF THE INVENTION

1. Field of the Invention

The present invention relates to an apparatus for supplying slide fastener sliders for use in combination with a slider holder for the attachment of sliders to pairs of slide fastener stringers. More particularly, this invention relates to an apparatus for supplying slide fastener sliders one at a time to a predetermined position, with the pull tab of the slider directed substantially perpendicularly to the slider body wings.

2. Prior Art

As well known in the art, a lock slider for slide fasteners comprises a pair of substantially parallel flat wings interconnected at one end by a neck or guide post, with the wings defining a substantially Y-shaped channel for guiding rows of coupling elements into and out of interlocked engagement, and a pull tab pivotally connected to one of the wings for operating the slider, the pull tab having a locking pawl movable into the guide channel for locking engagement with the coupling elements. Another known lock slider is of the type which comprises a locking pawl mounted on one of the wings and normally spring-biased into the guide channel and a pull tab pivotally connected to the locking pawl. With those lock sliders as described, the locking pawl projects into the guide channel for locking engagement with the coupling elements when the pull tab is put down into its recumbent position in which the pull tab lies flatwise against and extends parallel to the body wings beyond their rear ends. To unlock the slider, the pull tab must be lifted from the recumbent position to a raised position substantially perpendicular to the wings so as to retract the locking pawl out of the guide channel.

When a chain of coupling elements is to be threaded through such a lock slider, it is necessary that the pull tab be erected to withdraw the locking pawl out of the guide channel, with the slider being securely held on a holder against dislodgement.

U.S. Pat. No. 2,949,666, issued Aug. 23, 1960 shows an example of prior art device according to which the pull tab is directed substantially perpendicularly to the slider body wings by gravity while the slider travels down a chute. This device is however directed exclusively to sliders with no locking means, and hence is not applicable to lock sliders having pull tabs that are hard to be moved pivotally to an erected position only by gravity. It has therefore been common practice for the operator to lift the pull tab manually before application of the slider to the holder, a procedure which is time-consuming, tedius, and less productive. There has long been a need to provide an apparatus which can supply lock sliders to the holder, with pull tab being erected.

SUMMARY OF THE INVENTION

According to the invention, an apparatus for supplying slide fastener sliders comprises a track means which extends upwardly from a base and slidably carrying thereon the sliders stacked slideways with their respective pull tabs lying flatwise in the recumbent position for gravity delivery of the sliders to a guide groove in the base. A slider retaining means engages with the recumbent pull tab of the leading slider to retain the same in a position where the body of the leading slider is positioned just above the groove without engaging the retaining means. A pull tab orientating means serves to move the leading slider pull tab from its recumbent position into the raised position in which the pull tab is directed substantially perpendicularly to the slider wings so as to release the pull tab from engagement with the slider retaining means, and substantially at the same time to allow the leading slider to fall in the guide groove in the base. The slider is then fed by a feeding means in and along the groove to a predetermined position where it is to be received in a holder for application to a pair of slide fastener stringers.

The apparatus further comprises means for correcting the posture of the slider to have the pull tab raised substantially perpendicularly to the slider body wings.

An object of the present invention is to provide an apparatus for supplying lock sliders with their pull tabs erected for facilitating subsequent threading of chains of coupling elements therethrough.

Another object of the present invention is to provide an apparatus for supplying slide fastener sliders at an increased frequency.

Still another object of the invention is to provide a slider supplying apparatus which is simple in construction and less costly to manufacture.

These and other objects, features and advantages of the invention will be apparent from the following description, when taken in conjunction with the accompanying drawings which illustrate, by way of example, a preferred embodiment of the invention.

DETAILED DESCRIPTION

Figure 1:
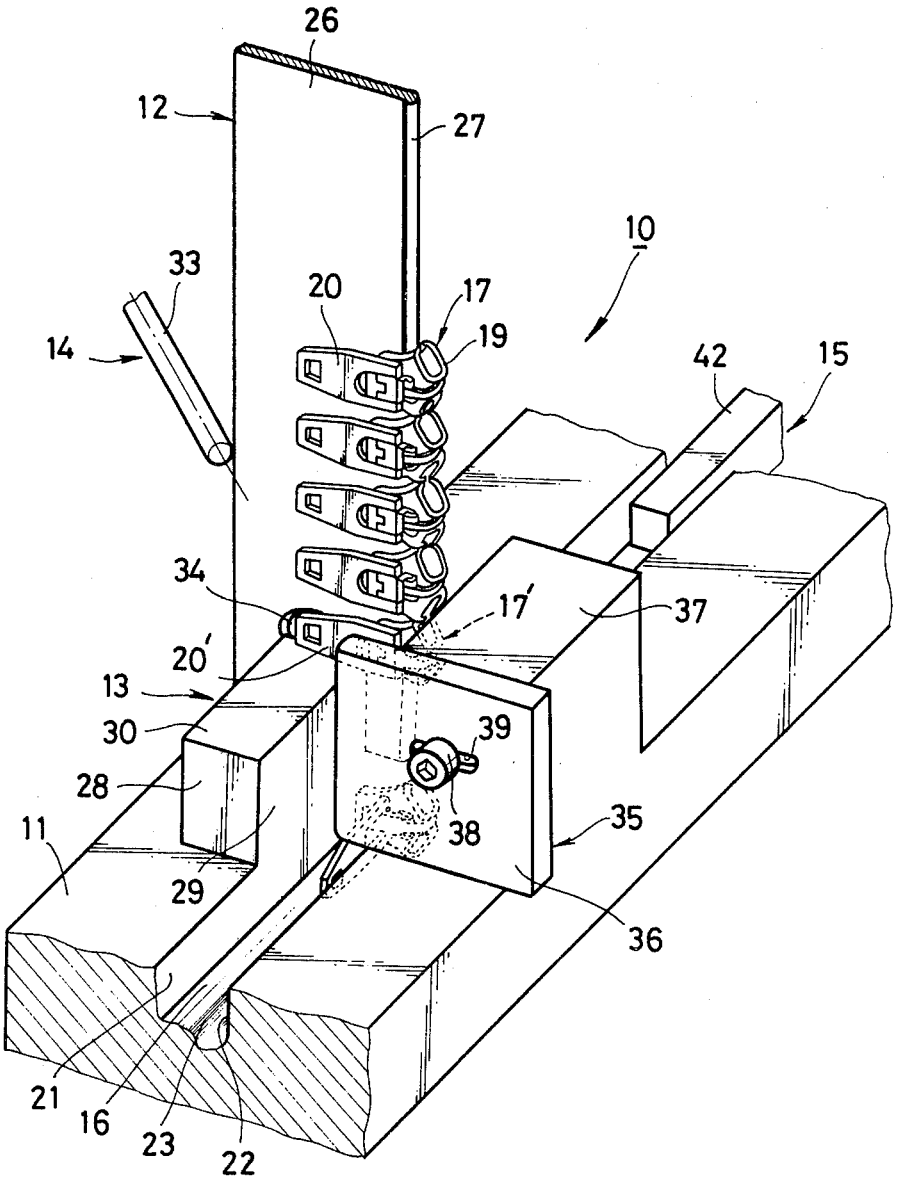
FIG. 1 is a fragmentary perspective view of a slide fastener supplying apparatus constructed in accordance with the present invention.
Figure 2:
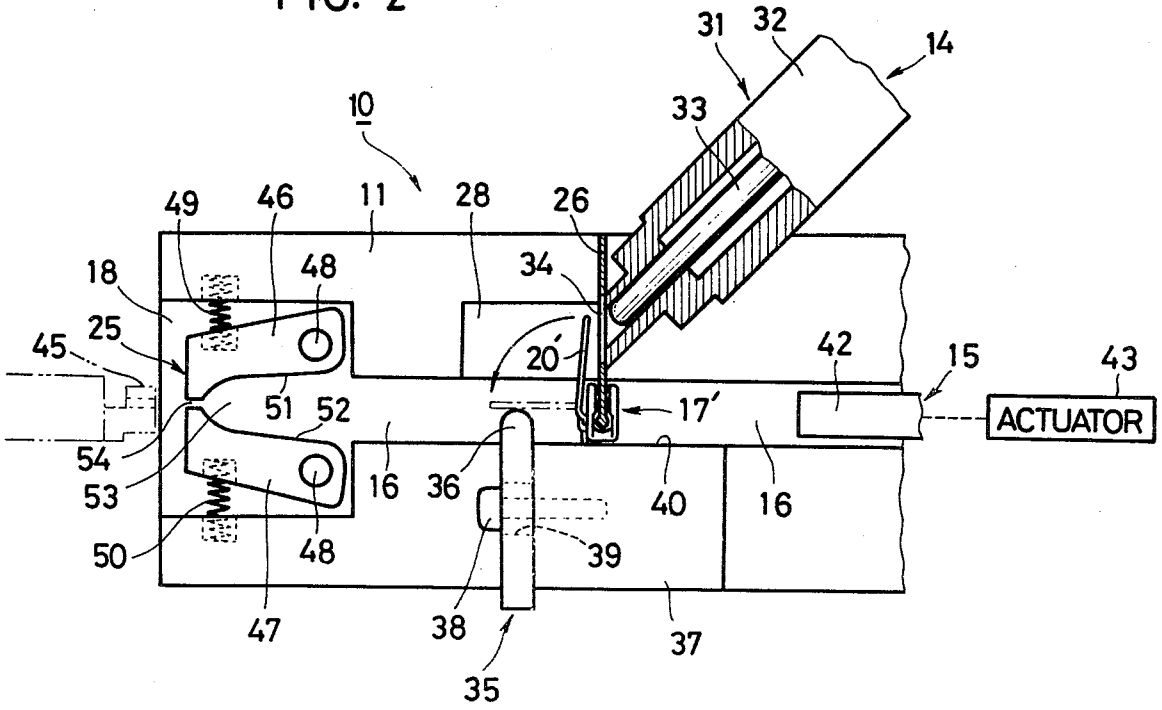
FIG. 2 is a schematic plan view, partly in cross-section, of the apparatus of FIG. 1.

The principles of the present invention are particularly useful when embodied in a slider supplying apparatus such as shown in FIGS. 1 and 2, generally indicated by the reference numeral 10.

The apparatus 10 generally comprises a base 11, a track means or chute 12, a slider retaining means 13, a pull tab orientating means 14 and a slider feeding means 15.

The base 11 has in its upper surface a groove 16 in and along which a slider 17 is fed to a discharge port 18 (FIG. 2) connected to one end of the groove 16. The slider 17 described herein is a lock slider having a body 19 consisting of a pair of spaced substantially parallel flat wings defining a guide channel therebetween, a pull tab 20 pivotally connected to one wing of the body 19, and a locking pawl movable into and out of the guide channel in response to pivotal movement of the pull tab 20. As the construction and operation of such lock slider 17 is well known in the art, no further description thereof will be necessary. The groove 16 is defined by a pair of confronting straight sidewalls 21, 22 and a bottom surface 23. The bottom surface 23 is formed complementarily in contour with a side edge of the slider body 19 so as to guide the slider 17 stably in posture therealong. The groove 16 has a width slightly larger than the length of the slider body 19 to allow the slider to be fed smoothly. The discharge port 18 is enlarged in width and includes a slider correcting means 25 (FIG. 2) as described hereinbelow.

The track means 12 is in the form of a chute blade 26 disposed endwise on the base 11 on one side of the groove 16 and extending upwardly from the base 11. The chute blade 26 has one longitudinal edge 27 carrying guidingly thereon a number of successive sliders 17 stacked sideways one on another and transversely overhanging the groove 16 for gravity delivery of the sliders 17 to the groove 16. The upper end of the chute blade 26 is connected to a hopper (not shown) from which the sliders 17 are successively fed to the chute blade 26 with the respective pull tab 20 arranged in the recumbent position or lying flatwise on the slider wing. The chute blade 26 has an opening 34 located just above the slider retaining means 13.

The slider retaining means 13 is comprised of a block 28 formed integrally with the base 11 and disposed at the same side of the groove that the chute blade 26 is located on, with an end wall thereof arranged in contact with one side of the chute blade 26. The block 28 has a sidewall 29 extending flush with the sidewall 21 of the groove 16 for allowing smooth sliding movement of the sliders 17 toward the groove 16. A top surface 30 of the block 28 is engageable with the pull tab 20′ of the leading slider 17′ as it is in the recumbent position, to thereby retain the slider body 19 just above the groove 16.

The pull tab orientating means 14 comprises means 31 for moving the pull tab 20′ of the leading slider 17′ pivotally from its recumbent position toward a raised position where the pull tab 20′ extends substantially perpendicularly to the wings of the slider body 19 and is directed to the discharge port 18 substantially parallel to the groove 16, and means 35 cooperative with the pull tab moving means 31 for positioning the leading slider pull tab 20′ in the raised position. The pull tab moving means 31 comprises a fluid-pressure actuator 32 (FIG. 2) mounted on the base 11 and a push rod 33 directed toward the opening 34 in the chute blade 26 and operatively connected to the fluid-pressure actuator 32 for reciprocating movement thereof upon actuation of the actuator 32. The fluid-pressure actuator 32 lies in parallel to the base 11 adjacent to the chute blade 26 but extends at an angle to the chute blade 26 and the groove 16. When the actuator 32 is energized, the push rod 33 extends through the opening 34 in the chute blade 26 to pivotally move the leading slider pull tab 20′ toward its raised position, so as to retract the locking pawl out of the guide channel in the slider 17′. The pull tab positioning means 35 comprises a plate 36 secured to a block 37 by a bolt 38 threadedly extending through an oblong aperture 39 in the plate 36 into the block 37. The block 37 is formed integrally with the base 11 at the other side of the groove 16 opposite to the longitudinal edge 27 of the chute blade 26. The plate 36 transversely overhangs the groove 16 for engagement with the pull tab 20′ when the latter is in its raised position. The plate 36 is positionally transversely adjustable by loosening the bolt 38. The block 37 has a sidewall 40 extending flush with the sidewall 22 of the groove 16 for preventing the leading slider 17′ from accidentally coming off from the chute blade 26 while the leading slider pull tab 20′ is being pushed by the push rod 33 to move into the raised position. When the actuator 32 is actuated to retract the push rod 33, the leading slider 17′ falls by gravity into the groove 16 with its pull tab 20′ directed substantially perpendicularly to the slider body wings.

The slider feeding means 15 comprises a push rod 42 extending in the groove 16 and operatively connected to a fluid-pressure actuator 43 (shown in block) mounted on the base 11. The push rod 42 is reciprocable, upon actuation of the actuator 43, in and along the groove 16 for feeding the slider 17′ dropped in the groove 16 through the slider correcting means 25 to the end of the discharge port 18 where the slider 17′ is to be received by a slider holder 45 illustrated in FIG. 2.

As shown in FIG. 2, the slider correcting means 25 comprises a pair of fingers 46, 47 disposed in the discharge port 18 and pivotally supported at their respective proximal ends respectively by a pair of pins 48, 48 on the base 11, and a pair of compression springs 49, 50 each acting between the base 11 and the distal end of one of the fingers 46, 47. The fingers 46, 47 have confronting inner surfaces 51, 52 configured to jointly define therebetween a converged bay 53 and a slot 54 contiguous to the bay 53. The compression springs 49, 50, in their free state, retain the fingers 46, 47 in such a position in which the slot 54 is normally defined for passage therethrough of the pull tab 20 of the slider 17. The confronting inner surfaces 51, 52 serve to guide the pull tab 20 toward the slot 54 against displacement of the pull tab 20 from its raised position which may have occurred due to engagement with foreign matters trapped in the groove 16.

In operation, the hopper feeds the sliders 17 to the chute blade 26 while keeping the pull tabs of the sliders arranged in the recumbent position. The sliders 17 travel sideways by gravity down the longitudinal edge 27 of the chute blade 26 toward the groove 16 in the base 11. Upon engagement of the pull tab 20′ of the leading slider 17′ with the top surface 30 of the block 28, the sliders 17 are retained in a position ready for the successive placement in the groove 16, with their respective bodies 19 vertically aligned with the groove 16. The fluid-pressure actuator 32 is then actuated to cause the push rod 33 to extend through the opening 34 in the chute blade 26 and move the leading slider pull tab 20′ pivotally from the recumbent position to the raised position until the pull tab 20′ abuts against the positioning plate 37. In this condition, the locking pawl retracts out of the guide channel in the slider 17′. When the actuator 32 retracts the push rod 33, the leading slider 17′ falls in the groove 16 with its pull tab 20′ directed substantially perpendicularly to the slider body wings. The push rod 42 is then pushed forwardly by the fluid-pressure actuator 43 to feed the slider 17′ along the groove 16 through the bay 53 and slot 54 to the end of the discharge port 18. As the slider 17′ passes through the correcting means 25, the position of the pull tab 20′ with respect to the slider body wings is corrected by the guiding engagement with the finger inner surfaces 51, 52 and the slot 54 even when the pull tab 20′ is displaced out of its raised position upon engagement with the foreign matters in the groove 16. At the end of the discharge port 18, the pull tab 20′ is received in a slot in the slider holder 45 for subsequent attachment of the slider to a pair of slide fastener stringers.

While only one embodiment of the present invention has been shown and described in detail, it will be easy for those skilled in the art to devise many modifications and variations on the basis of this disclosure without departing from the spirit and scope of the invention as expected in the following claims.

What is claimed is:

1. An apparatus for supplying slide fastener sliders one at a time to a predetermined position, each of the sliders including a body having a pair of substantially parallel flat wings interconnected at one end by a neck and a pull tab pivotally connected to one of the wings, said apparatus comprising:

(a) a base having a groove with at least one end opened for passage of the sliders;

(b) track means extending upwardly from said base and having a longitudinal edge for carrying slidably thereon the sliders stacked sideways with their respective pull tabs arranged in the recumbent position for gravity delivery of the sliders to said groove;

(c) means on said base engageable with said recumbent pull tab of the leading slider for retaining the same on said longitudinal edge with the body of said leading slider positioned just above the groove without engaging said retaining means;

(d) means for releasing said leading slider pull tab from retaining engagement with said slider retaining means, and for orientating said leading pull tab from said recumbent position into the raised position where it is directed substantially perpendicularly to the slider wings and to said one end of said groove, thereby allowing the leading slider to fall into said groove; and (e) means for feeding said slider which has fallen into said groove in and along the latter through said one open end to the predetermined position.

2. An apparatus according to claim 1, said groove having a width slightly larger than the length of the slider body and a bottom surface being configured complementarily in contour with a side edge of the slider body wings for stably guiding the slider therealong.

3. An apparatus according to claim 1, said track means comprising a chute blade disposed on said base at one side of said groove and having one longitudinal edge for carrying slidably thereon the sliders stacked sideways and transversely overhanging said groove.

4. An apparatus according to claim 1, said slider retaining means comprising a block disposed on said base adjacent to said track means, said block having a sidewall extending flush with one sidewall of said groove and a top surface engageable with said recumbent pull tab of the leading slider.

5. An apparatus according to claim 1, said pull tab releasing and orientating means comprising means for moving the leading slider pull tab pivotally from its recumbent position toward said raised position, and means cooperative with said pull tab moving means for positioning said leading slider pull tab in said raised position.

6. An apparatus according to claim 5, said pull tab moving means comprising a fluid-pressure actuator disposed on said base adjacent to and extending at an angle to said track means remotely from said pull tab retaining means and a push rod operatively connected to said fluid-pressure actuator for moving pivotally said recumbent pull tab to its raised position, said track means having an opening through which said push rod is reciprocable upon actuation of said fluid-pressure actuator, and said pull tab positioning means comprising a plate disposed adjustably on said base at the other side of said groove and overhanging transversely said groove for engagement with said raised pull tab.

7. An apparatus according to claim 1, said slider feeding means comprising a fluid-pressure actuator disposed on said base and a push rod operatively connected to said fluid-pressure actuator and reciprocable in and along said groove upon actuation of said fluid-pressure actuator.

8. An apparatus according to claim 1, further comprising means disposed adjacent to said one end of the groove for correcting the slide fastener pull tab into said raised position.

9. An apparatus according to claim 8, said groove including an enlarged discharge port adjacent at said one end, said correcting means comprising a pair of confronting fingers disposed in said discharge port and each pivotally supported at its proximal end on said base, said fingers having respective confronting inner surfaces which define a converged bay downstream of said groove, and spring means acting between said base and the distal end of each of said fingers for retaining, in its free state, said fingers in a position where a slot is normally defined for passage of the pull tab therethrough.

10. An apparatus according to claim 1, further comprising a block disposed on said base at the other side of said groove, said block having a sidewall extending flush with the other sidewall of said groove for preventing the slider from transversely coming off from said track means.

* * * * *